US007741791B2

(12) United States Patent
Rahmane et al.

(10) Patent No.: US 7,741,791 B2
(45) Date of Patent: Jun. 22, 2010

(54) HIGH PRESSURE DISCHARGE LAMP CONTROL METHOD

(75) Inventors: Mohamed Rahmane, Clifton Park, NY (US); Eric Croquesel, Paris (FR); Svetlana Selezneva, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 263 days.

(21) Appl. No.: 11/818,786

(22) Filed: Jun. 15, 2007

(65) Prior Publication Data

US 2009/0001902 A1 Jan. 1, 2009

Related U.S. Application Data

(62) Division of application No. 10/954,878, filed on Sep. 30, 2004, now Pat. No. 7,250,732.

(51) Int. Cl.
*H05B 37/02* (2006.01)

(52) U.S. Cl. ..... 315/291; 315/246; 315/308

(58) Field of Classification Search ..... 315/32, 315/37, 246, 291, 307–309
See application file for complete search history.

(56) References Cited

U.S. PATENT DOCUMENTS 5,187,414 A * 2/1993 Fellows et al. ..... 315/307
5,534,755 A 7/1996 Deavenport et al.
5,608,294 A 3/1997 Derra et al.
6,215,252 B1 4/2001 Stanton
6,239,556 B1 5/2001 Derra et al.
6,586,892 B2 7/2003 Derra et al.
6,631,996 B2 10/2003 Moench et al.
6,717,375 B2 4/2004 Noguchi et al.
6,956,336 B2 * 10/2005 Ribarich ..... 315/247
7,327,096 B2 * 2/2008 Monch et al. ..... 315/291
7,432,665 B2 * 10/2008 Geijtenbeek et al. ..... 315/291
2002/0008851 A1 1/2002 Moench et al.
2002/0011803 A1 1/2002 Derra et al.
2003/0222605 A1 * 12/2003 Okamoto et al. ..... 315/308
2004/0245945 A1 12/2004 Coulwenberg et al.

* cited by examiner

*Primary Examiner*—David Hung Vu
*Assistant Examiner*—Tung X Le
(74) *Attorney, Agent, or Firm*—Mary Louise Gioeni

(57) ABSTRACT

A system for providing a controllable current to a high intensity discharge lamp is provided. The system includes a current controller that is configured to receive input power and to provide an output current waveform to the high intensity discharge lamp. This current causes a discharge of light from the lamp. The output current waveform includes an absolute value amplitude in each half cycle that is generally constant during a first portion and that which increases non-linearly from the generally constant amplitude to a peak amplitude during a second portion.

6 Claims, 5 Drawing Sheets

HIGH PRESSURE DISCHARGE LAMP CONTROL METHOD

CROSS-REFERENCE TO RELATED APPLICATIONS

This application is a divisional of Ser. No. 10/954,878, filed Sep. 30, 2004, now U.S. Pat. No. 7,250,732 entitled HIGH PRESSURE DISCHARGE LAMP CONTROL SYSTEM AND METHOD in the name of Mohamed Rahmane et al.

BACKGROUND

The invention relates generally to the field of electric lamps and visual projection systems, and more particularly to high intensity discharge lamps employed for use in the visual projection systems.

High Intensity Discharge (HID) lamps are high-efficiency lamps that can generate large amounts of light from a relatively small source. These lamps are widely used in many applications, including highway and road lighting, lighting of large venues such as sports stadiums, floodlighting of buildings, shops, industrial buildings, and projectors, to name but a few. The term "HID lamp" is used to denote different kinds of lamps. These include mercury vapor lamps, metal halide lamps, and sodium lamps. Metal halide lamps, in particular, are widely used in areas that require a high level of brightness at relatively low cost. HID lamps differ from other lamps because their functioning environment requires operation at high-temperature and high pressure over a prolonged period of time. Also, due to their usage and cost, it is desirable that these HID lamps have relatively long useful lives and produce a consistent level of brightness and color of light. Though in principle the HID lamps can operate with either an alternating current (AC) supply or a direct-current (DC) supply; in practice, however, the lamps are usually driven via an AC supply.

Typical construction of an HID lamp includes a pair of electrodes enclosed within an arc tube with a pressurized gas. Light is generated by the hot gas or "plasma," sometimes referred to as a "discharge" made by an electrical current that flows through the gas. The electrodes play a significant role in determining the amount of brightness of the light produced by the HID lamp. Electrode material is typically a refractory metal such as tungsten. The construction of the lead wire assembly includes a combination of one or more metals having a high melting point. Examples of materials used in the lead wire include tungsten, niobium, and molybdenum. During operation, current applied to the electrodes causes a decrease in resistance of the gas by creating a plasma discharge, permitting the flow of electrons across the gas medium and between the electrodes. This decrease in resistance causes the current to increase continuously. A driving circuit or ballast regulates the current and voltage applied to the electrodes.

The shortest distance of separation between the two electrodes positioned at opposite ends of the arc tube is called the arc length. This is the distance an arc jumps in the high-pressure gas medium to produce a discharge of light. The temperature of the electrode tip at the instant the arc appears increases substantially. Due to the decreasing resistance resulting from the arc, current increases and causes heating of the exposed electrode tip. This heating may, in fact, cause vaporization of the electrode tip, followed by recondensation of the electrode material, eventually forming a spike or extension at the tip. This change can result in reduced life of the HID lamp, a flicker in the emitted light (as the point of discharge changes with the tip geometry), a temporary change in the arc length, and a voltage variation across the electrodes. Flicker is primarily caused when the arc reattaches itself to the electrode at various spots. In projection systems, for example, this manifests itself as changes in intensity of light on projection systems due to occurrence of maximum intensity of light in spots not always at the focal point of lens assemblies in the projection systems. All of these effects are undesirable.

Currently existing techniques attempt to address the various effects by increasing the dimension of the electrodes at their tips. This results in a reduction in temperature of the electrode tip during arcing. However, the electrodes still undergo a change in geometry due to vapor transport of electrode material. The increased dimension of the electrode tips also lead to a less stable arc for reasons discussed earlier. Other existing solutions include control of the waveform used to drive the lamps. However, these have not fully addressed the problems or resolved the issue of flicker, useful life or control of the electrode tip geometry.

There is, therefore, a need for an improved approach to controlling an HID lamp that reduces the continuous change of electrode shape during operation of the lamp. There is a particular need for lamps of this type that exhibit reduced or little flickering of emitted light, and reduced voltage variation, with prolonged life.

BRIEF DESCRIPTION

According to one aspect of the present technique, a system for providing a controllable current to a high intensity discharge lamp is provided. The system includes a current controller that is configured to receive input power and to provide an output current waveform to the high intensity discharge lamp. This current causes a discharge of light from the lamp. The output current waveform includes an absolute value amplitude in each half cycle that is generally constant during a first portion and which increases non-linearly from the generally constant amplitude to a peak amplitude during a second portion.

According to another aspect of the present technique, a method for supplying a controllable current to a high intensity discharge lamp is provided. The method includes a step of providing the controllable current that includes at least one portion that varies exponentially with time to the high intensity discharge lamp.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
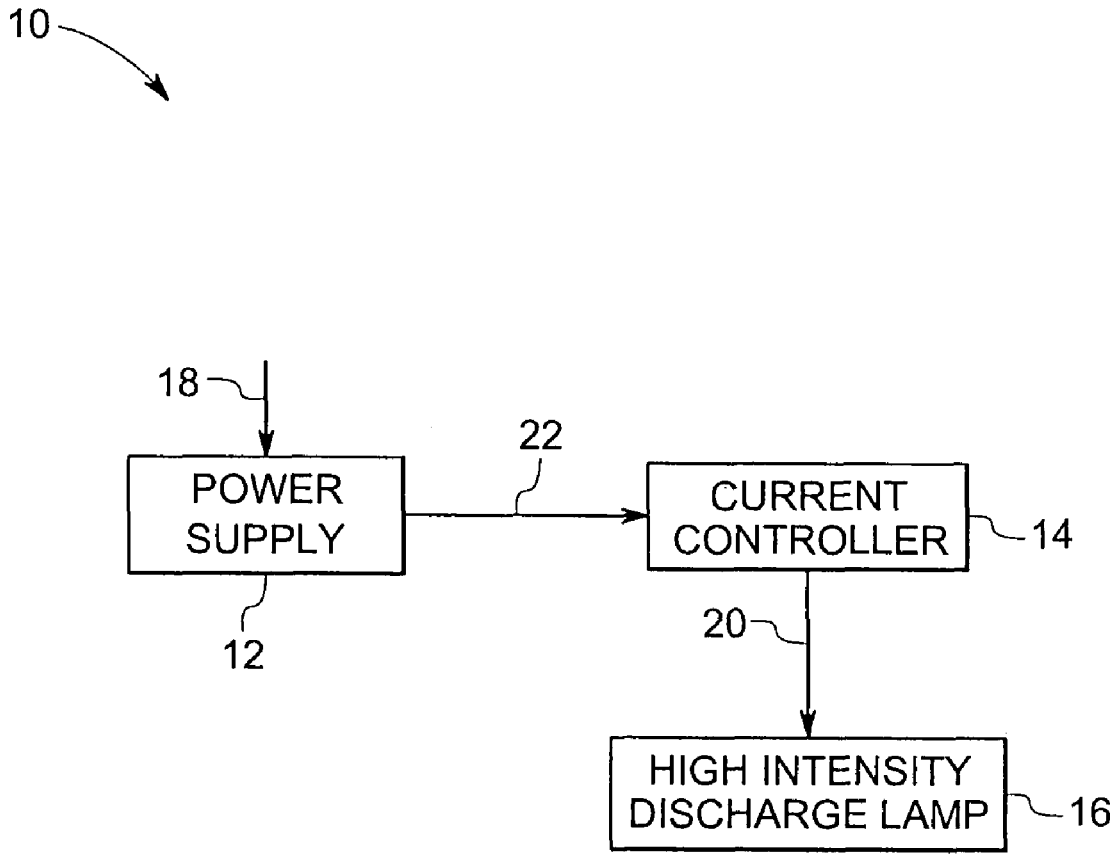
FIG. 1 is a diagrammatical illustration of an exemplary embodiment of a system for providing a controllable current to a high intensity discharge lamp.

Turning now to the drawings and referring first to FIG. 1, an exemplary system 10 for providing a controllable current to a high intensity discharge (HID) lamp is illustrated. The system 10 includes a power supply 12, a current controller 14 and an HID lamp 16.

The power supply 12 draws electrical power 18 from power mains and supplies the electrical power to the current controller 14. It is worth noting that in typical applications, the drawn electrical power supplies an alternating current (AC). In certain embodiments, the power supply 12 may directly provide the drawn AC electrical power to the current controller 14 while in other exemplary embodiments, the power supply 12 may transform the drawn electrical power to appropriate levels acceptable by the current controller 14. Common approaches for appropriate transformations of electrical power include using either a step-down transformer or a step-up transformer.

The current controller 14 is electrically coupled to the power supply 12 and draws electrical power 18 from it. The current controller 14 produces a controllable current 20 that drives the HID lamp 16. A detailed explanation of the controllable current 20 and the HID lamp 16 will be provided in later sections. In certain embodiments, the current controller 14 may include an electronic ballast to control the current 22 flowing to the HID lamp 16. As will be appreciated by those skilled in the art, such ballasts may be programmed by appropriate software or firmware, or may be physically configured, to generate the waveforms and to provide the types of control summarized in greater detail below. Furthermore, it should be noted that the term 'HID lamp' also refers equally to HID lamps with short arc lengths. Such lamps are typically used in video projection.

The present techniques for controlling operation of an HID lamp are based upon physical effects that have been recognized by the inventors to take place in such lamps as a result of the control described below. The present discussion includes a description of such lamps and effects to provide a better understanding of the control and its beneficial features. The discussion is not intended to be limiting as to the scope of the appended claims.

Figure 2:
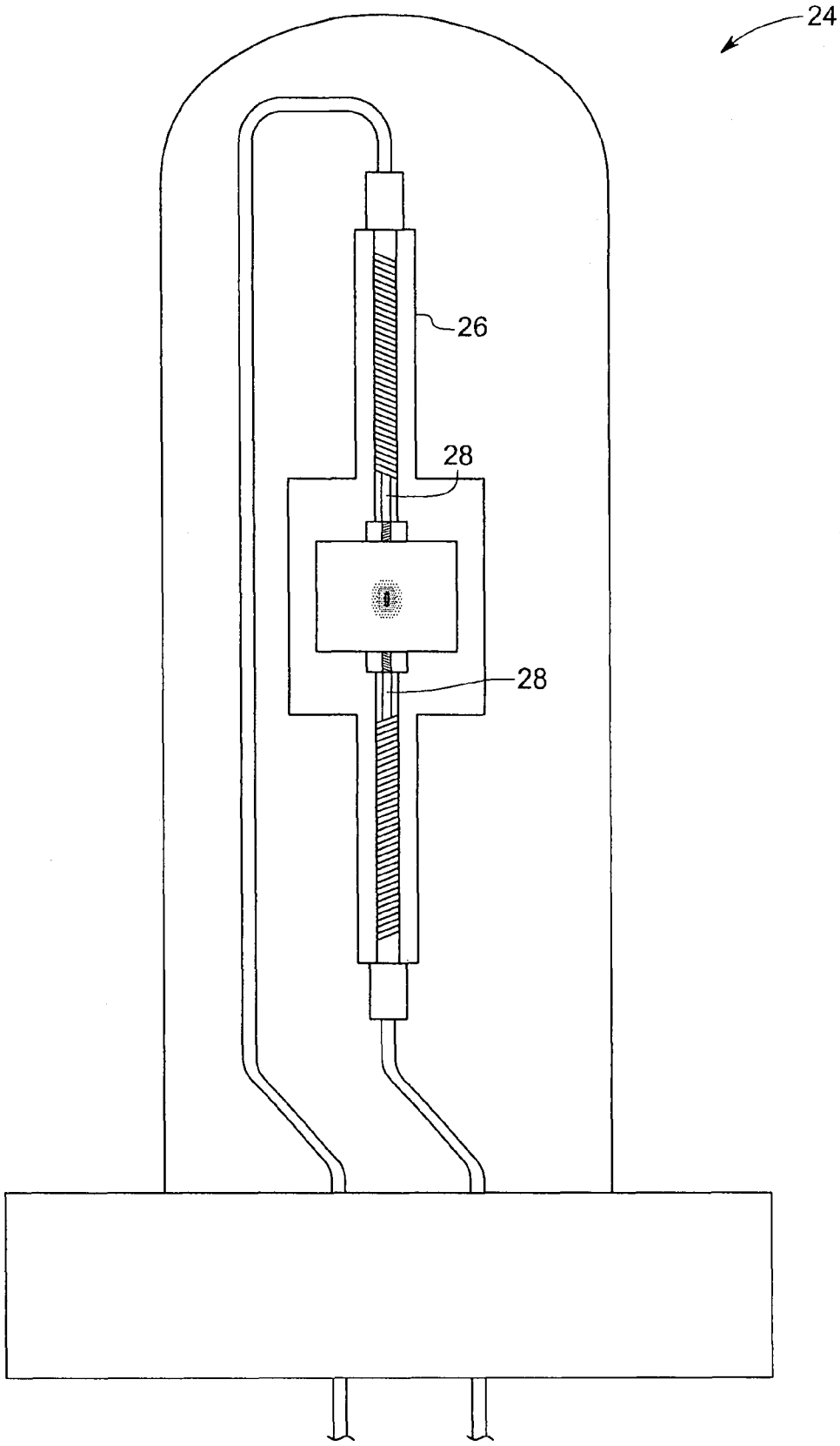
FIG. 2 is a diagrammatical illustration of an exemplary high intensity discharge lamp as illustrated in FIG. 1 for use in the present technique.

FIG. 2 diagrammatically represents a cross-sectional view of an HID lamp 24 illustrating an arc tube 26 that includes a pair of electrodes 28 and 30 disposed at opposing ends of the arc tube 26. The two electrodes 28 and 30 are typically fed with an alternating current (e.g. from the controller discussed above with referenced to FIG. 1). When the HID lamp is powered ON, indicating a flow of current to the lamp, a voltage difference is caused across the two electrodes. This voltage difference causes an arc to appear between the electrodes. Because the electrodes are supplied with an AC current, both the electrodes 28 and 30 function as an anode electrode and a cathode electrode in each cycle. The arc results in a plasma discharge in the region between the opposing ends of the two electrodes. The current in the arc, and its location, depend on a variety of factors that include characteristics of the supplied current to the lamp and the design of the electrodes. The characteristics of the supplied AC current include frequency of the current and the amplitude of the current, as well as the shape of the current waveform.

When arcing occurs in the HID lamp, due to the nature of the arc itself, the temperature at the electrode tips increases. Typically, the tips of the electrodes are made of tungsten because of its high melting point and low work function. In various other embodiments, the electrodes may be made of other suitable metals of sufficiently high melting point. The inventors have recognized that, during operation, the electrode tips undergo a time-dependent thermal cycle that causes subsequent heating and cooling at the electrode tips. The cycle results from the AC current waveform applied to the electrodes. Over a complete cycle, the amplitude of the current waveform undergoes an increase followed by a decrease before increasing again. Therefore, the absolute value of the AC current also varies accordingly. Because the electrode heating depends on the current amplitude the heating of the electrode tips from which the arcs emanate is similarly cyclical The increase in the current amplitude results in highly localized heating at the electrode tips especially during the anode phase. A consequence of such heating is vaporization of electrode material in a location where the arc attaches. This vaporization takes place over a very small duration of time. However, since the current waveform changes its polarity every half-cycle, the temperature of the electrode tips also drops every half-cycle (i.e. during the time when the drive voltage changes polarity and the current changes direction). During the cooling phase, the evaporated electrode material condenses back on the electrode. Because this process repeats continuously over a period of time, a protrusion gradually forms on the electrode tips that can be significant enough to decrease the arc length. This arc length is generally the direct distance between the two electrodes placed at opposing ends on the high intensity discharge lamps, between which the arc extends when the lamp is energized.

In accordance with the present technique, the thermal cycling resulting from the application of current to the electrodes may be controlled, thereby controlling the evolution of the form of the electrodes. By way of example, if the electrode material is made of tungsten, the thermal cycling may proceed as follows. If $P_{eqs}$ denotes the saturation vapor pressure of tungsten at equilibrium and $P_{actual}$ denotes the vapor pressure of tungsten at the electrode tip during operation in accordance with one aspect of the present technique, when the ratio of $P_{actual}$ to $P_{eqs}$ is greater than 1, the vapor pressure of tungsten immediately adjacent to the electrode tip is greater than saturation vapor pressure of tungsten at equilibrium. This supersaturation is caused by highly localized and rapid heating of the electrode especially when operating in anode mode. Condensation of tungsten at the electrode tip occurs immediately following removal of current from the same electrode. Therefore, the evaporation and condensation of tungsten depend on a maximum temperature attained at the electrode tip and the cooling rate. Both parameters may be controlled by regulation of the frequency of the AC current supplied to the lamp and the waveform of the current.

Figure 3:
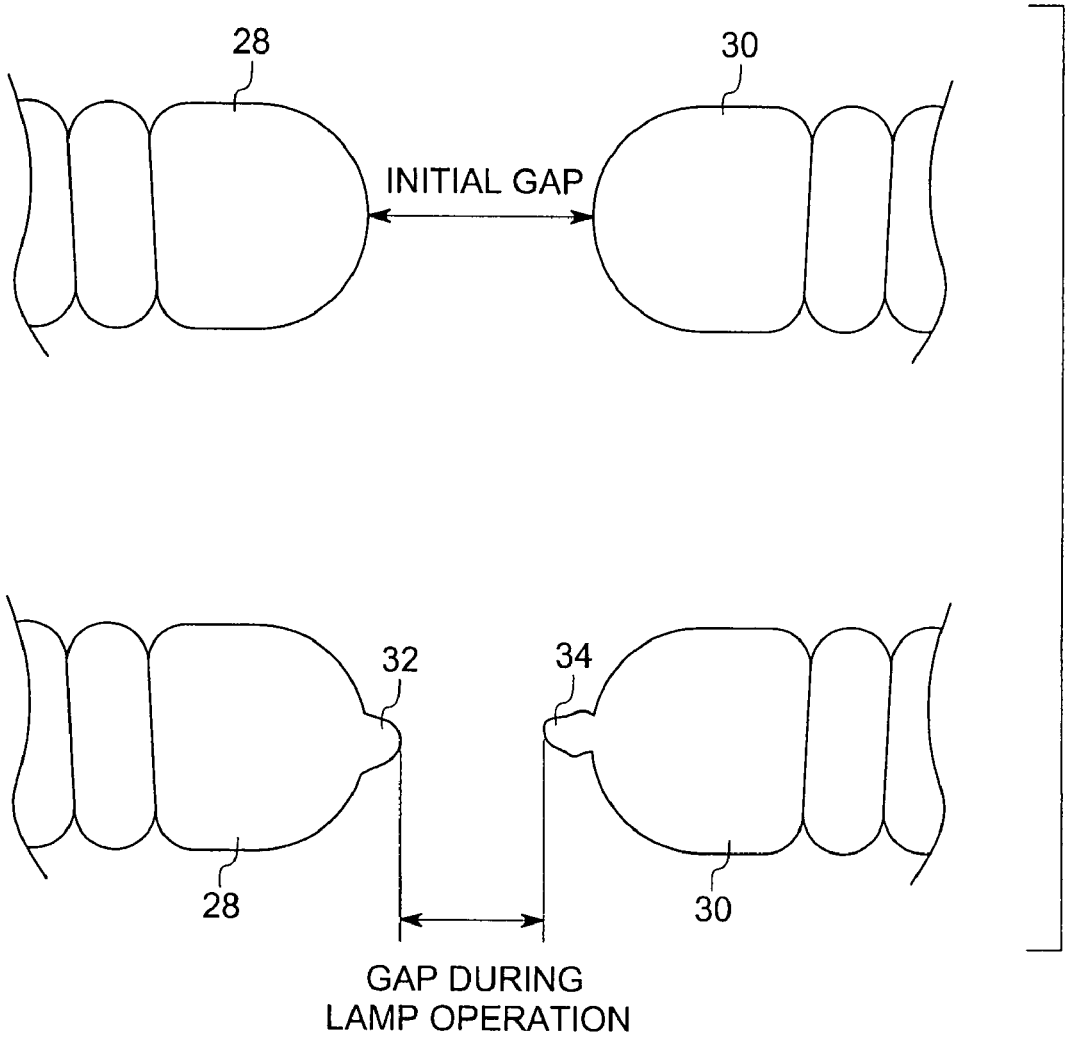
FIG. 3 is a diagrammatical illustration of an exemplary effect of formation of protrusions on tips of a pair of electrodes disposed at opposing ends of a high intensity discharge lamp, as illustrated in FIG. 2.

The formation of such protrusions 32 and 34 on electrode tips 28 and 30 respectively is diagrammatically illustrated in FIG. 3 for the exemplary high intensity discharge lamp as illustrated in FIG. 2. As can be seen in FIG. 3, the tips 28 and 30 of a new lamp may be generally rounded and smooth. During application of a voltage to one of the electrodes, placing it in anode mode, current will begin to flow as an arc is formed across the gap between the electrodes. The location of the attachment of the arc may not be as predictable as desired during this phase of operation. However, by controlling the vaporization and redeposition (i.e. condensation) of material from each of the electrodes, protrusions 32 and 34 gradually form. The size and shape of these protrusions is generally regulated by the control of the current applied to the electrodes in accordance with the present technique.

It has been found that proper control of the formation of protrusions 32 and 34 can enhance operation of the lamp. In particular, as the protrusions enhance localization of the points of attachment of the arcs exchanged during operation, flickering, which may be caused by movement of the arc attachment point, is significantly reduced. Moreover, the gap between the electrodes may be more accurately controlled, leading to better control of intensity of emissions and the arc voltage and current. The ultimate life of the lamp may also be enhanced due to enhanced control of heating.

Figure 4:
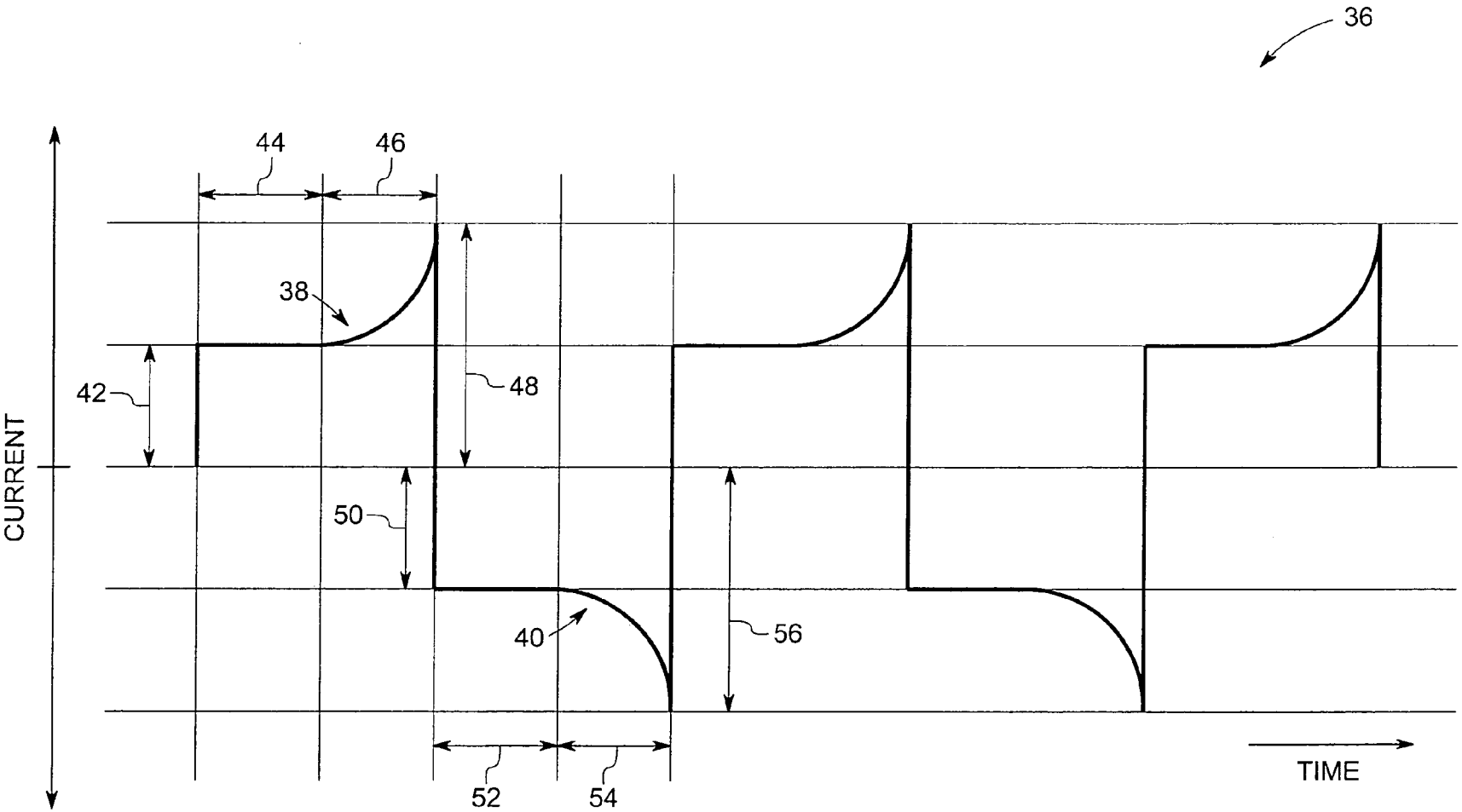
FIG. 4 is a diagrammatical illustration of an exemplary controllable current waveform for driving a high intensity discharge lamp as illustrated in FIG. 2 according to certain aspects of the present technique.

FIG. 4 illustrates an exemplary current waveform 36 generated by the current controller 14 (illustrated in FIG. 1) as the controllable current 20 and that is provided for operation of the HID lamp 16. The current waveform 36 is alternating in nature, meaning that the current waveform 36 includes a positive half cycle portion 38 and a negative half cycle portion 40. In the illustrated embodiment, the positive half cycle portion 38 of the current waveform 36 includes four different portions 42, 44, 46 and 48. The first portion 42 includes the leading edge of the waveform over a brief period during which the current amplitude rises to a specific value following onset of the half cycle. The second portion 44 maintains the specific constant amplitude over a desired period, while the third portion 46 has amplitude that increases non-linearly over time to a specific peak value. In the illustrated embodiment, this third portion follows a generally non-linear, and more particularly, an exponentially increasing increase to the peak value. The fourth portion 48 corresponds to trailing edge of the half cycle, during which the amplitude of the current drops from the peak value to zero.

The above-described four portions of the current complete the positive half cycle 38 of the current waveform. The current waveform 36 now continues to the negative half cycle 40 with similar portions 50, 52, 54 and 56. The four portions 50 through 56 are identical to the four portions 42 through 48, respectively, except for the change in direction of the current. The positive and negative portions of the waveform thus place each electrode alternatively in anode mode and cathode mode, resulting in controlled formation of protrusions from each electrode, as described above.

The exemplary current waveform 36 may be varied in a variety of ways. These include changing the cycle of the current waveform, which is the time taken to complete one positive half cycle and one negative half cycle. Also, the peak value of the third portion of the current waveform may be controlled to a higher or lower value. This causes a difference in maximum attainable temperature at the electrode tip. That is, it has been found that the temperature of the electrode tip (particularly the electrode then operating in anode mode) is highly dependent the amplitude of the current, particularly the sudden rise near the end of the waveform. In a present embodiment, it is particularly during this phase of operation that the desired vaporization and supersaturation of material near the tip occurs. It is also possible to vary the duration of the second portion of the current waveform and the third portion of the current waveform such that the total duration always equals one half cycle for the current waveform 36. As will be appreciated by those skilled in the art, the overall energy applied to the electrodes may nevertheless be kept generally constant by adjusting these durations and the amplitudes of the current during each respective period. Additionally, it is worth noting that these changes can be equally applied to both the positive half cycle as well as the negative half cycle.

Figure 5:
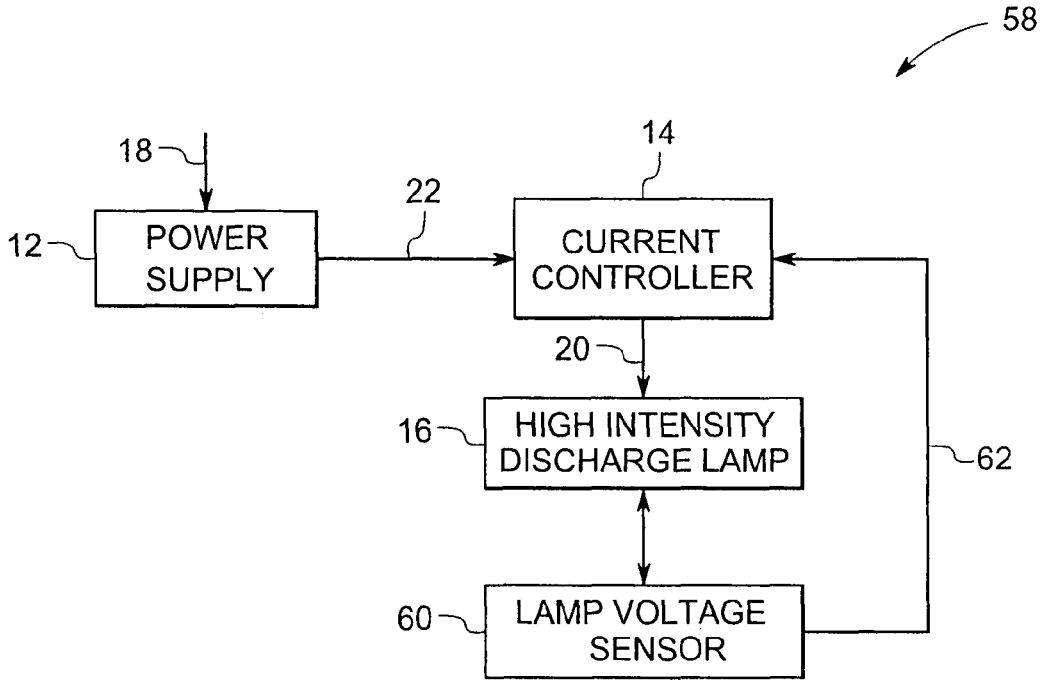
FIG. 5 is a diagrammatical illustration of another exemplary embodiment of a system for providing a controllable current to a high intensity discharge lamp.

In accordance with another embodiment of the technique, FIG. 5 illustrates an exemplary system 58 for providing a controllable current 20 via the current controller 14 (illustrated in FIG. 1) to the HID lamp 16. In this embodiment, the system 56 also includes a lamp sensor 60 configured to sense the voltage across the HID lamp 16. As will be appreciated by those skilled in the art, the voltage required to produce the arc discharge may vary as a function of arc length. That is, if the arc length increases, the voltage across the HID lamp also increases and vice versa. As noted above, the arc length may change over the life of the lamp due to formation of protrusions on each electrode. The formation of these protrusions may, in turn be controlled as described above. Moreover, the heating of the electrodes (and the protrusions in particular, once formed) may be regulated by altering the current applied to the electrodes as the arc length changes, as reflected by the sensed voltage.

In accordance with one embodiment, when the arc length increases, as indicated by a greater voltage applied by the controller, the peak value of the current supplied to the HID lamp may be increased. When the arc length decreases, as indicated by a lower voltage applied to the lamp to obtain the desired discharge, the peak value of the current supplied to the HID lamp may be decreased. More often than not, during the operation of the HID lamp, the arc length of the lamp during operation decreases due to the formation of protrusions at the electrode tips. Therefore, the peak value of the supplied AC current may be decreased. Decreasing the peak value of the AC current also results in a decrease in the formation of the protrusions in the electrode tips.

The lamp sensor 60 provides feedback 62 to the current controller 14 based on which the current controller 14 would alter the characteristics of the controllable current 20 supplied to the HID lamp 16. Such characteristics of the controllable current may include those described above with reference to FIG. 4. Thus by controlling the characteristics of the current based upon sensed voltage across the electrodes, temperature of electrode tips as well as shape of the electrodes themselves may be controlled. Furthermore, by controlling these two aspects of the electrodes, the problem of lamp flicker can be significantly reduced. As noted above, lamp flicker primarily occurs when the arc between the electrodes reattaches itself to different portions of the electrode tips due to the frequent change in shape of the electrode tips as well surface area of the electrodes at the tip.

Figure 6:
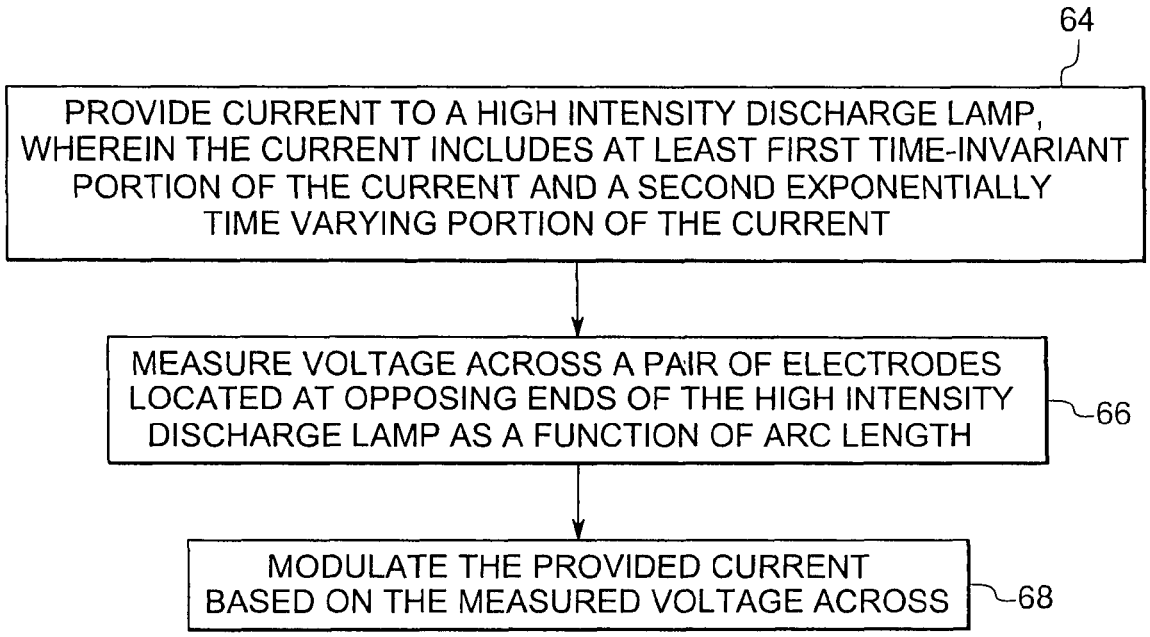
FIG. 6 is a diagrammatical illustration of a method of providing a controllable current to a high intensity discharge lamp as illustrated in FIG. 1 and FIG. 5.

In the present context, an exemplary method for providing a controllable current to a high intensity discharge lamp is illustrated in FIG. 6. The method involves providing, at step 64, a controllable current to a high intensity discharge lamp, such as of the type illustrated in FIG. 2. The method further involves measuring, at step 66, a voltage across the lamp. Finally, the method involves adjusting the controllable current, at step 68, based on the measured voltage across the lamp. Adjusting the controllable current may involve altering one or more of current waveform characteristics, such as frequency of the waveform, peak amplitude of the current and the shape of the current waveform.

Furthermore, measurements of the protrusions in the electrode tips and geometry of the electrodes during lamp operation by the application of the exemplary current waveform (as illustrated in FIG. 4) have provided evidence that the geometry of the electrodes remains fairly unchanged over time and that the protrusion sizes can be controlled in a more efficient way by the application of such a current.

According to certain aspects of the present technique, a method is thus available for controlling flicker of light emitted from a high intensity discharge lamp. This approach involves controlling at least one of an effect of vaporization of electrode material at the electrode tip or a condensation of the electrode material back onto the electrode tip. The causes and effects of vaporization and condensation of electrode material are described above with reference to FIG. 2.

In a presently contemplated embodiment, the two effects of the current applied to the lamp may be controlled to reduce flicker. A first effect is the shape of the electrode. A second is the size of the protrusion formed at the electrode tips. More particularly, by suitably controlling at least one of amplitude of the current supplied to the lamp, the frequency of the current and the shape of the current waveform, the shape of the electrode and the size of the protrusions at the electrode tips may be controlled. The shape of the exemplary current waveform illustrated in FIG. 4 may be controlled by varying individual portions of the current waveform in both the positive half cycle and the negative half cycle of the alternating current waveform.

According to another aspect of the present technique, an exemplary method is available for reducing changes in morphology of a pair of electrodes disposed within an HID lamp. As noted above, the technique may include sensing a voltage across the HID lamp as the voltage, and particularly the voltage required to cause discharge between the pair of electrodes. As also noted above, the controllable current to the HID lamp may then be altered based upon this measured voltage to alter the temperature at the electrode tips during lamp operation.

As will be appreciated by those of ordinary skill in the art, the systems and the techniques described hereinabove have a significant impact on the operation of an HID lamp by providing the HID lamp with a controllable current. The controllable current is responsible for reducing the amount of flicker in the light emitted from the HID lamp due to controlled deformation of the electrode tips. The technique further facilitates a decreased consumption of electrical current and reduced heating by altering the magnitude of the supplied current that result in a prolonged life of the HID lamp. While the above techniques have been illustrated for application in HID lamps, it should be noted that the techniques can be equally applied to any other type of discharge lamps as desired and appropriate.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method for supplying a controllable current to a high intensity discharge lamp, comprising:

providing the controllable current to the high intensity discharge lamp, wherein the controllable current includes current waveform including an absolute value amplitude in each half cycle thereof that is generally constant during a first portion thereof and that increases non-linearly from the generally constant amplitude to a peak amplitude during a second portion thereof.

2. The method of claim 1, further comprising sensing a voltage across a pair of electrodes of the high intensity discharge lamp.

3. The method of claim 2, comprising controlling formation of protrusions from electrodes of the high intensity discharge lamp based upon the sensed voltage.

4. The method of claim 1, comprising altering at least one of frequency of the controllable current, and amplitude of the controllable current.

5. The method of claim 1, comprising altering the controllable current based on a measured voltage across the pair of electrodes.

6. A method for reducing changes in morphology of at least one electrode disposed within a high intensity discharge lamp, comprising:

sensing a voltage between a pair of electrodes of the high intensity discharge lamp; and supplying a controllable current that defines a current waveform including an absolute value amplitude in each half cycle thereof that is generally constant at a non-zero value during a first portion thereof and that increases non-linearly from the generally constant amplitude to a peak amplitude during a second portion thereof to the high intensity discharge lamp to increase temperature at tip of the at least one electrode based upon the sensed voltage.

* * * * *